US007482988B2

(12) United States Patent
Sugimoto et al.

(10) Patent No.: US 7,482,988 B2
(45) Date of Patent: Jan. 27, 2009

(54) NOISE RECEPTION REDUCING ARRANGEMENT

(75) Inventors: Yuji Sugimoto, Kariya (JP); Toshihiro Hattori, Okazaki (JP); Toru Yamazaki, Chita (JP); Koji Numata, Toyokawa (JP); Masaaki Hisada, Obu (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 0 days.

(21) Appl. No.: 11/580,984

(22) Filed: Oct. 16, 2006

(65) Prior Publication Data

US 2007/0097000 A1 May 3, 2007

(30) Foreign Application Priority Data

Oct. 27, 2005 (JP) ..... 2005-313042

(51) Int. Cl.
*H01Q 1/32* (2006.01)
*H01Q 1/52* (2006.01)

(52) U.S. Cl. ..... 343/713; 343/834; 343/841

(58) Field of Classification Search ..... 343/711–713, 343/833, 834, 841

See application file for complete search history.

(56) References Cited

U.S. PATENT DOCUMENTS 5,012,255 A * 4/1991 Becker ..... 343/704
5,083,133 A * 1/1992 Takayama ..... 343/704

FOREIGN PATENT DOCUMENTS

| | | |
|---|---|---|
| JP | A-2002-009522 | 1/2002 |
| JP | A-2003-115694 | 4/2003 |
| JP | A-2004-260504 | 9/2004 |
| JP | A-2004-268653 | 9/2004 |

* cited by examiner

*Primary Examiner*—Michael C Wimer
(74) *Attorney, Agent, or Firm*—Posz Law Group, PLC

(57) ABSTRACT

An antenna is mounted in a vehicle for receiving a radio wave of a specified wavelength, and an electronic device such as a meter device is mounted in the vehicle. The electronic device tends to generate radiation noise when being operated. To reduce reception of the radiation noise by the antenna, a passive conductor element is located between the antenna and the electronic device to reflect a part of the radiation noise. The passive element is away from the electronic device by a distance that is about multiple times of one-quarter of the specified wavelength and is about multiple times of one-half of the specified wavelength in length.

9 Claims, 4 Drawing Sheets

NOISE RECEPTION REDUCING ARRANGEMENT

CROSS REFERENCE TO RELATED APPLICATION

This application is based on and incorporates herein by reference Japanese Patent Application No. 2005-313042 filed on Oct. 27, 2005.

FIELD OF THE INVENTION

The present invention relates to an arrangement of reducing reception of radiation noises generated from vehicle-mounted electronic devices and entering into a vehicle-mounted antenna.

BACKGROUND OF THE INVENTION

An automotive vehicle recently is equipped with various in-vehicle antennas for a television, a radio, a global positioning system (GPS), a vehicle information and communication system (VICS), an electronic toll collection (ETC) or the like. These antennas are in many cases mounted near electronic devices such as a meter display device or a navigation display device, which generates electromagnetic radiation noise. As a result, the antenna tends to receive the radiation noise, and will be adversely affected in receiving a desired radio wave.

JP 2002-9522A proposes an electromagnetic shield in an electronic device, which generates radiation noise. This shield may be effective in a small-sized device having no display part. This shield, however, is not advantageous to cover with the electromagnetic shield electronic devices such a meter display device or a navigation display device, which are rather large in size. It is therefore necessary to suppress generation of radiation noise in electronic devices.

SUMMARY OF THE INVENTION

It is therefore an object of the present invention to provide radiation noise reception reducing arrangement, which does not require suppression of generation of radiation noise in electronic devices.

According to one aspect of the present invention, an arrangement of reducing radiation noise reception includes a passive element provided between an antenna that receives a radio wave of a specified wavelength and an electronic device that generates radiation noise when operated. To reflect a part of the radiation noise, the passive element is away from the electronic device by a distance that is about a multiple of one-quarter of the specified wavelength and is about a multiple of one-half of the specified wavelength in length.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE EMBODIMENT

First Embodiment

Figure 1:
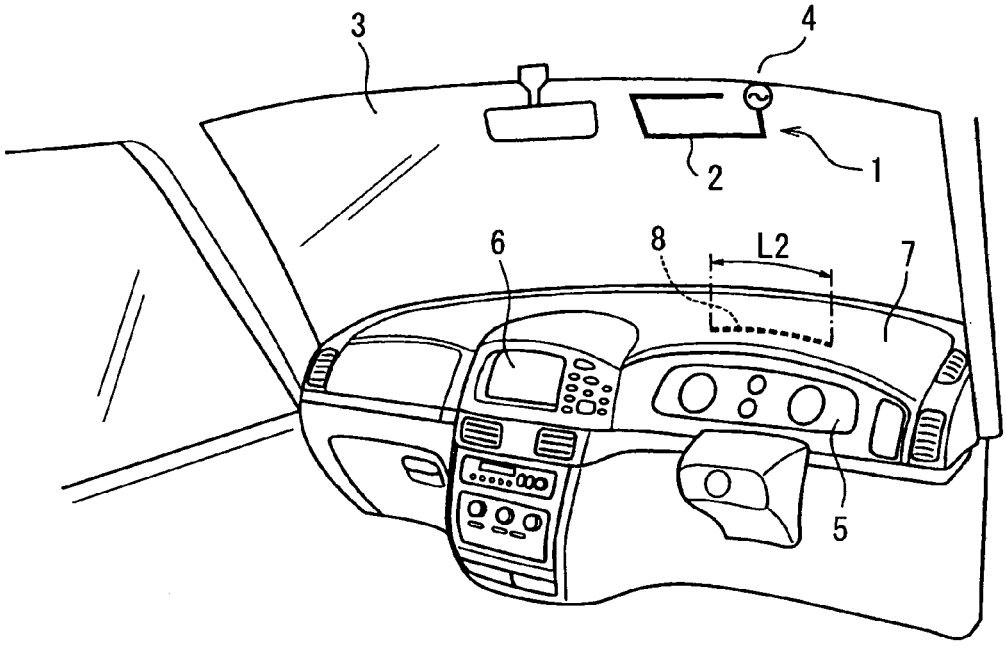
FIG. 1 is a perspective view showing arrangement of an antenna and electronic devices in a vehicle according to a first embodiment of the present invention.
Figure 2:
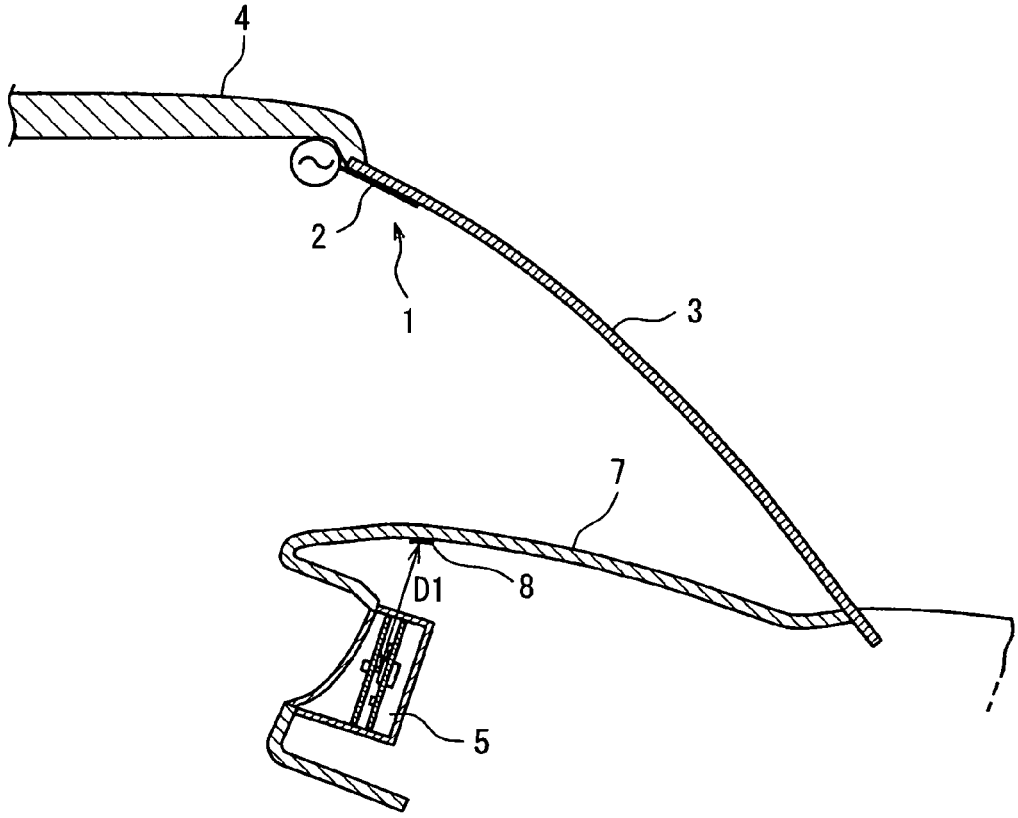
FIG. 2 is a sectional view showing the arrangement of the first embodiment.

Referring to FIGS. 1 and 2, an in-vehicle antenna 1 is attached to an upper part of a front windshield 3 near a rear-view mirror. The antenna 1 is a film antenna of harmonic excitation type and has an element 2. The length L1 of the element 2 is designed to be about a multiple (integer) of one-quarter of the specified wavelength λ of a radio wave to be received. This antenna 1 is designed in consideration of the wavelength reduction ratio (0.7 to 0.8) caused by the dielectric constant of a glass of the windshield 3. One end of the element 2 is electrically connected to a vehicle chassis (metal) 4 to be grounded. The antenna 1 may be for receiving the radio wave in the 470 MHz band, which is a frequency band of a television broadcasting.

Inside a vehicle compartment, a meter device 5 having a meter display panel and a navigation device 6 having a navigation display panel are mounted as in-vehicle devices. The display panels of those in-vehicle devices 5, 6 generate electromagnetic noises as radiation noises.

Figure 3:
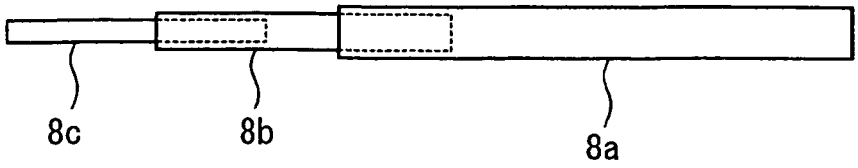
FIG. 3 is a schematic view showing a passive element used in the first embodiment.

It is assumed in this embodiment that the meter device 5 generates the radiation noise. Inside a dashboard 7, a line-shaped passive element 8 is provided to extend generally in horizontal direction between the antenna 1 and the meter device 5. Specifically, the passive element 8 is located at a position away from the center of the meter device 5 by a distance D1 upward. This distance D1 is set to about a multiple (integer) of one-quarter of the wavelength λ of the radio wave, which the antenna 1 is designed to receive. The length L2 of the passive element 8 is set to about a multiple (integer) of one-half of the wavelength λ of the radio wave, which the antenna 1 is designed to receive. The passive element 8 may be provided by plating a conductive metal and attached to the inside surface of the dashboard 7. Alternatively, the passive element 8 may be a connection of three metal rods 8*a*, 8*b*, 8*c*, which are assembled to be changeable in length telescopically as shown in FIG. 3.

With the distance D1 and the length L2, the passive element 8 operates as a reflector to reflect a noise component of wavelength, which corresponds to about a multiple of λ/2 of the radio wave which the antenna 1 receives. Thus, the passive element 8 reduces the radiation noise, which will otherwise be received at the antenna 1.

Figure 4:
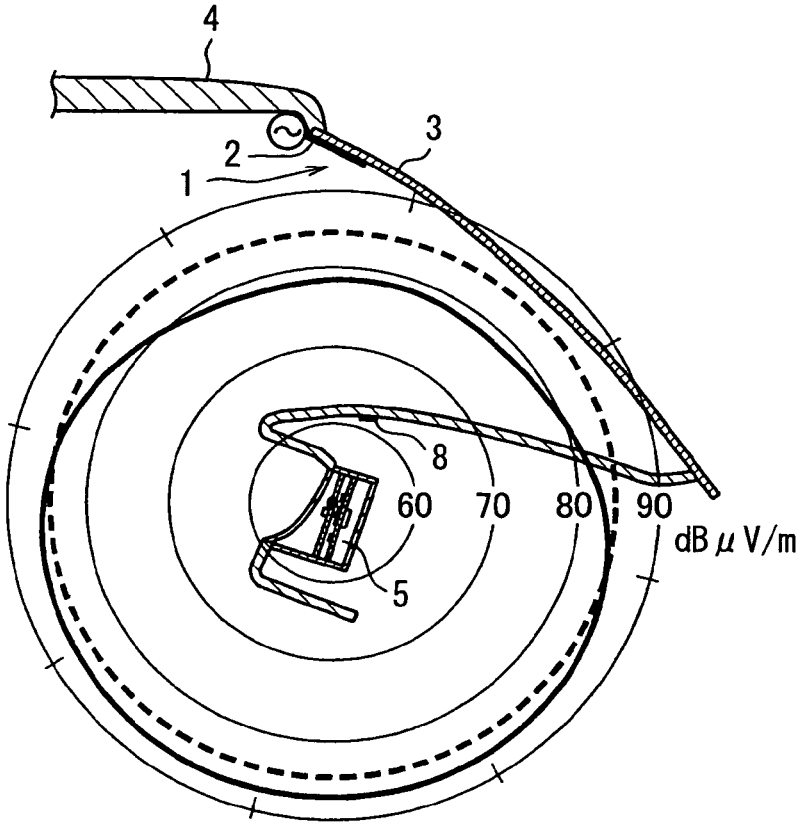
FIG. 4 is a schematic diagram showing a simulation result of the first embodiment.

A simulation result of the first embodiment is shown in FIG. 4, in which a solid line and a dotted line indicate radiation patterns in the cases that the passive element 8 is present and absent, respectively. In this simulation, a radio wave source of 0 dBm is assumed in the meter device 5. As understood from FIG. 4, the passive element 8 reduces by about 6 dB the radiation noise propagating toward the antenna 1 from the meter device 5 in comparison to the case of no passive element.

It is noted that another passive element may be provided between the navigation device 6 and a GPS antenna (not shown) to reduce the reception of radiation noise by the GPS antenna by setting, in the similar manner as the above embodiment, the distance and length of such a passive element based on a wavelength of a radio wave which the GPS antenna is designed to receive.

The passive element 8 is thus advantageous to effectively reduce the radiation noise, which the antenna 1 receives. The antenna 1 is enabled to maintain its wave reception performance without being lowered by the radiation noise. Further, the passive element 8 is provided underside the dashboard 7. Therefore, it cannot be viewed by a driver or passengers and will not damage outlook of the compartment. If the passive element 8 is a telescopic type shown in FIG. 3, it can be used for many antennas designed to receive respective radio waves of different frequency.

Second Embodiment

Figure 5:
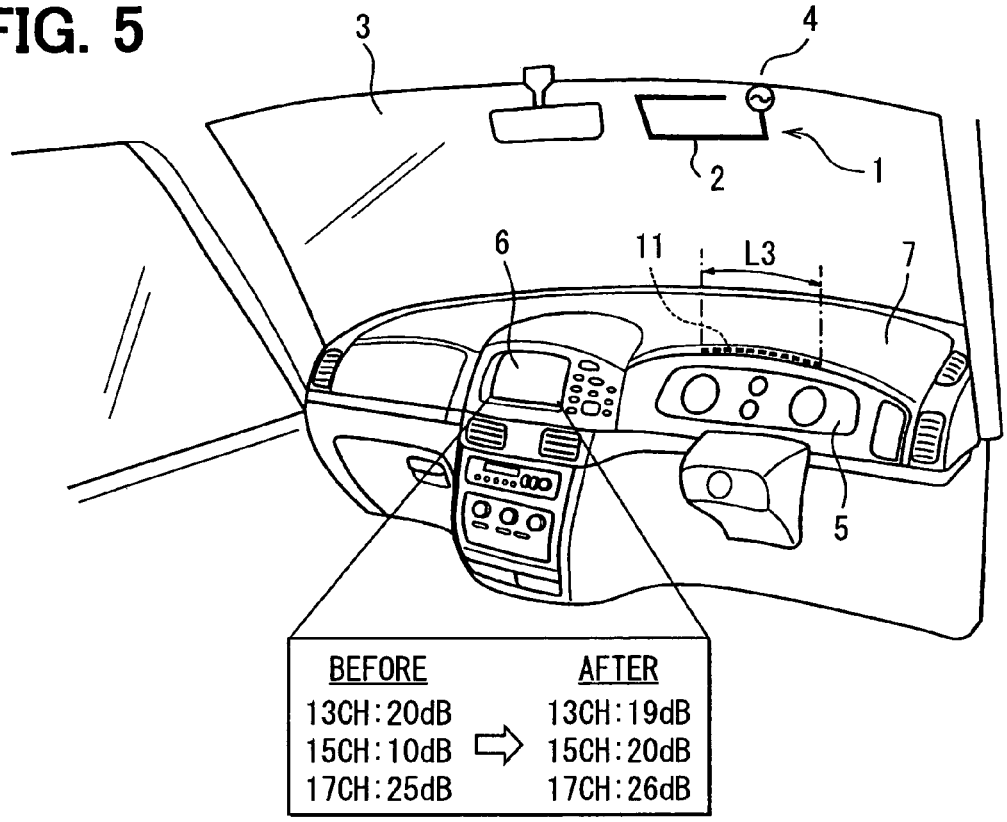
FIG. 5 is a perspective view showing arrangement of an antenna and electronic devices in a vehicle according to a second embodiment of the present invention.
Figure 6:
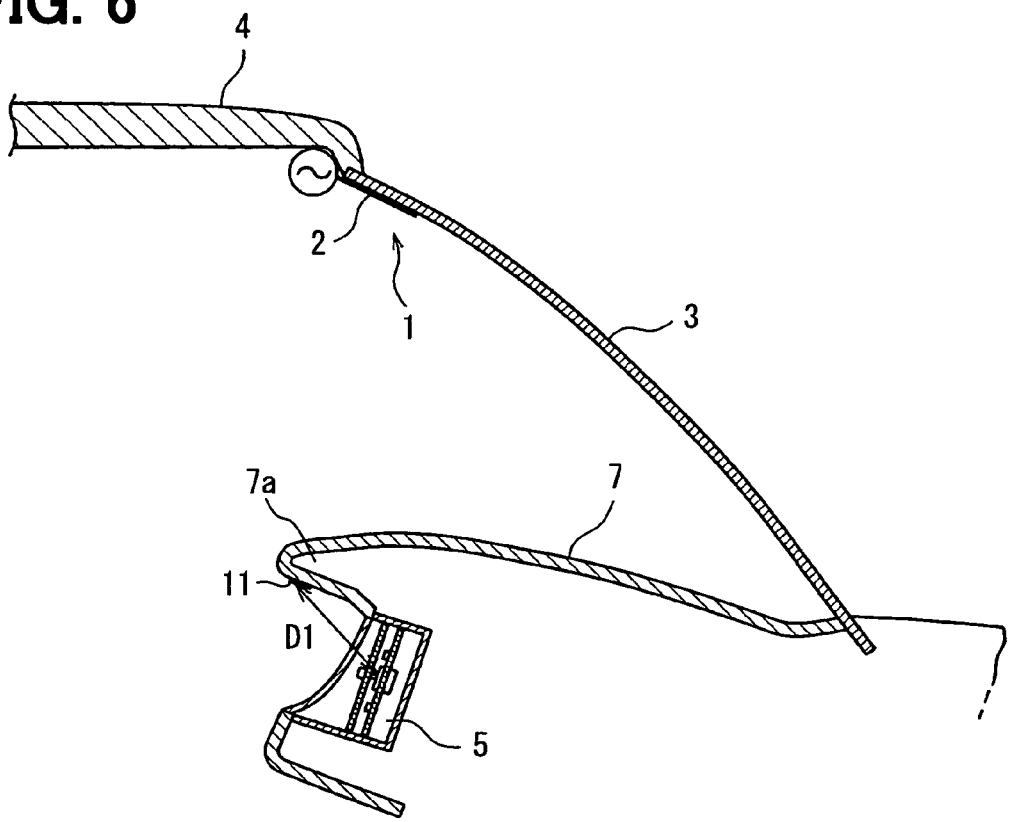
FIG. 6 is a sectional view showing the arrangement of the second embodiment.

In the second embodiment, as shown in FIGS. 5 and 6, a passive element 11 is provided outside the dashboard 7 but underside a hood part 7*a* of the dashboard 7. The hood part 7*a* extends over the meter device 5 toward the rear side of the vehicle, and hence the passive element 11 is not so visible.

The passive element 11 is a film sheet type and located between the antenna 1 and the meter device 5 at the distance D1, which is about a multiple of $\lambda/4$ of the radio wave to be received by the antenna 1. The passive element has a length L3, which is about a multiple of $\lambda/2$ of the radio wave to be received by the antenna 1. The passive element 11 is constructed to be adjustable in length and in location of installation.

In the similar manner as in the first embodiment, the passive element 11 operates as a reflector and effectively reduces the noise component, the frequency of which corresponds to about a multiple of $\lambda/2$ of the radio wave to be received by the antenna 1. Since the passive element 11 is outside the dashboard 7, it can be adjusted easily even after installation. As shown in FIG. 5, the navigation device 6 is constructed to display on its display panel signal-to-noise (S/N) conditions of each channel before and after adjustments, when the passive element 11 is adjusted. As a result, this display assists a driver or passengers to maximize reduction of the radiation noise, which will interfere with the radio wave to be received by the antenna 1, by watching the displayed data. This report about pre-adjustment and post-adjustment radio wave reception conditions may be attained by any other devices.

Third Embodiment

Figure 7:
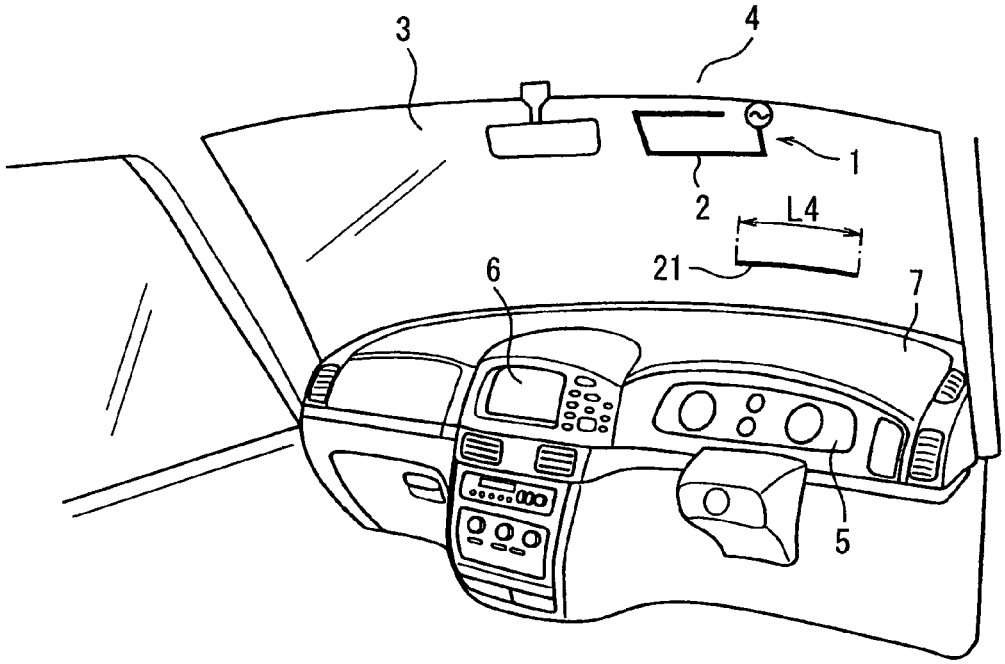
FIG. 7 is a perspective view showing arrangement of an antenna and electronic devices in a vehicle according to a third embodiment of the present invention.

In the third embodiment, as shown in FIG. 7, a passive element 21 is provided detachably on the windshield 3 between the antenna 1 and the meter device 5 at a position, which is away from the meter device 5 by about a multiple of $\lambda/4$ of the radio wave to be received by the antenna 1. The passive element 21 is in a line-shaped film pattern and about a multiple of $\lambda/2$ of the radio wave to be received by the antenna 1 in length in the horizontal direction.

This passive element 21 also operates as a reflector in the similar manner as those in the first and the second embodiments. In addition, the passive element 21 may be easily adjusted in length and installation position by a driver or passengers, because it is on the windshield.

Fourth Embodiment

Figure 8:
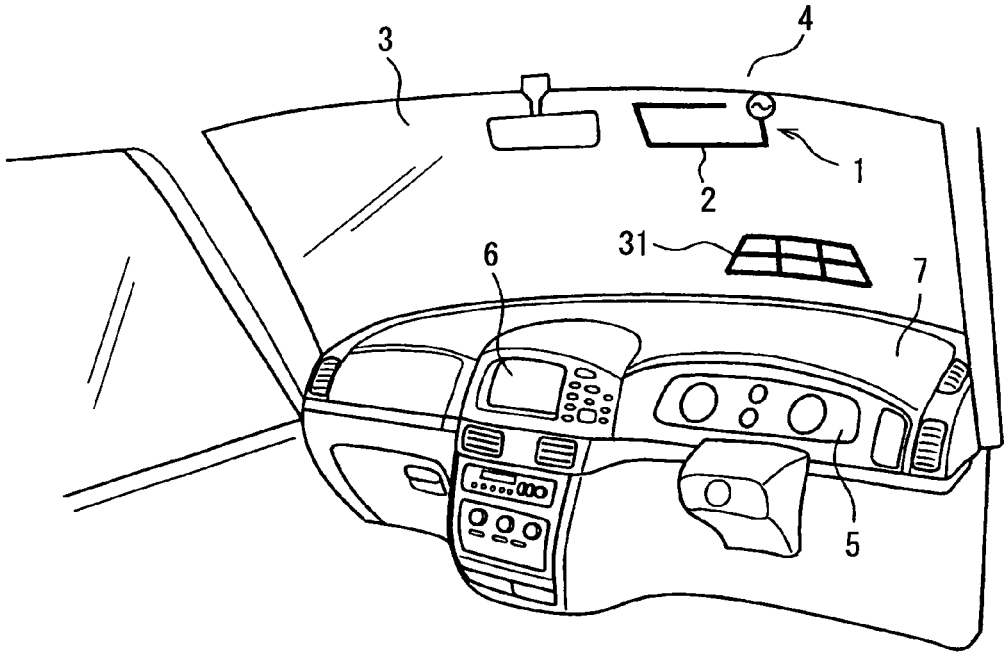
FIG. 8 is a perspective view showing arrangement of an antenna and electronic devices in a vehicle according to a fourth embodiment of the present invention.

In the fourth embodiment, as shown in FIG. 8, a passive element 31 is detachably provided on the windshield 3 between the antenna 1 and the meter device 5 in the similar manner as in the third embodiment. The passive element 31 is mesh-shaped to have a plurality of line segments including a segment of about a multiple of $\lambda/2$ of the radio wave to be received by the antenna 1.

The passive element 31 also operates as a reflector in the similar manner as those in the first to the third embodiments. In addition, the mesh shape is effective to reflect radiation noise generated from the meter device 5 over wider range of frequencies.

The above embodiments may be modified in various ways. For instance, an in-vehicle antenna may be a table-top type to be placed on a dashboard in a vehicle compartment, may be attached to other windshields than the front windshield. A plurality of antennas may be combined to attain diversity reception.

What is claimed is:

1. An arrangement of reducing radiation noise reception comprising:

an antenna mounted in a vehicle for receiving a radio wave of a specified wavelength;

an electronic device mounted in a vehicle, the electronic device generating radiation noise when being operated; and a passive element located between the antenna and the electronic device to reflect a part of the radiation noise, the passive element being away from the electronic device by a distance that is about multiple times of one-quarter of said specified wavelength and being about multiple times of one-half of said specified wavelength in length, the passive element disposed as separate from the antenna.

2. The arrangement according to claim 1, wherein the passive element is in a mesh-shape of a plurality of line segments including a line segment of about multiple times of one-half of the specified wavelength in segment length.

3. The arrangement according to claim 1, wherein the passive element is located inside a dashboard near the electronic device.

4. The arrangement according to claim 1, wherein the passive element is located on a windshield of the vehicle or outside a dashboard near the electronic device.

5. The arrangement according to claim 1, further comprising:

a reporting device provided in the vehicle for reporting pre-adjustment and post-adjustment radio wave reception conditions of the antenna, when the passive element is adjusted in location.

6. The arrangement according to claim 1, further comprising:

a reporting device provided in the vehicle for reporting pre-adjustment and post-adjustment radio wave reception conditions of the antenna, when the passive element is adjusted in length.

7. The arrangement according to claim 1, wherein the passive element is a reflector that reflects the radiation noise.

8. The arrangement according to claim 1, wherein the electronic device includes a display that generates the radiation noise.

9. The arrangement according to claim 1, wherein the passive element is disposed to extend in a width direction of a vehicle.

* * * * *